United States Patent [19]

Perper

[11] Patent Number: 4,538,094

[45] Date of Patent: Aug. 27, 1985

[54] LAMP BALLAST WITH NEAR UNITY POWER FACTOR AND LOW HARMONIC CONTENT

[75] Inventor: Lloyd J. Perper, Tucson, Ariz.

[73] Assignee: Iota Engineering Co., Tucson, Ariz.

[21] Appl. No.: 522,505

[22] Filed: Aug. 12, 1983

[51] Int. Cl.[3] ..... H05B 37/02

[52] U.S. Cl. ..... 315/221; 315/223; 315/278

[58] Field of Search ..... 315/278, 221, 223, 247

[56] References Cited

U.S. PATENT DOCUMENTS

| | | | |
|---|---|---|---|
| 2,025,471 | 12/1935 | Osborne | 315/278 |
| 2,928,990 | 3/1960 | Siljeholm et al. | 315/278 |
| 3,781,595 | 12/1973 | Samuels | 315/247 |
| 4,045,711 | 8/1977 | Pitel | 315/205 |
| 4,105,931 | 8/1978 | Prichard et al. | 315/278 |

*Primary Examiner*—Harold Dixon

*Attorney, Agent, or Firm*—Harris, Kern, Wallen & Tinsley

[57] ABSTRACT

A magnetic ballast circuit for a fluorescent lamp providing improved power factor, reduced harmonic content and increased efficiency. A ballast circuit with three inductances connected to a junction, preferably with the first and second inductances comprising a tapped autotransformer, with the third inductance connected between a line terminal and the tap, with the first inductance connected in series with a capacitance to the other line terminal, and with the second inductance connected to the load. The first inductance may be provided totally as part of the autotransformer, or may be supplemented with a second inductance in series. In an alternative embodiment, separate inductances may be utilized.

9 Claims, 3 Drawing Figures

LAMP BALLAST WITH NEAR UNITY POWER FACTOR AND LOW HARMONIC CONTENT

BACKGROUND OF THE INVENTION

This invention relates to magnetic ballast for fluorescent lamps and in particular, to a new and improved ballast which has near unity power factor with low harmonic content and improved efficiency.

In the past, magnetic ballast circuits have been of three types: inductive, capacitive and resistive. Since a fluorescent lamp tends to have a high impedance and low current before ignition, and the reverse thereafter, it has been conventional to employ an impedance in series with the lamp to provide a high starting voltage and a reduced operating current.

In the pre-heat inductive circuit, the lamp is typically connected in series with an inductor and energized from two opposing filament terminals. The other two terminals are connected to a starter, typically a gas-tube-operated contactor and capacitor in parallel. When a voltage is first applied, the lamp filaments are cool and the starter gas-tube ignites at a lower voltage than the lamp. As the gas-tube warms, its built-in contactors close; filament current flows in the lamp and the inductor is energized. The closing of the contactors removes the voltage from the gas-tube, which cools, opening the contactors, which then cycle on and off. Each time that the contactors open, the energy stored in the series inductor tends to produce a voltage spike across the lamp, whose breakdown voltage with heated filaments is lower than that of the gas-tube. When the lamp ignites, the gas-tube extinguishers and its contact cycle ceases. The parallel capacitor in the starter is used to suppress electromagnetic effects associated with transients generated in the system.

This form of uncorrected magnetic ballast has a low power factor (typically 0.55) since the current passing through the inductor lags the applied voltage. Also it has appreciable ohmic loses in any practical size and cost configuration. By way of example, 3–5 watts in a typical 20 watt lamp ballast.

The inductor operating region is typically such as to be in partial saturation at maximum pre-heat current. The swinging choke characteristics are of critical importance. Of three inductors, all testing the same inductance and resistance on a meter, one could operate properly as a ballast; the second could fail to light the lamp; and the third could blow out the lamp filaments.

Series capacitive ballasting is closely related to inductive ballasting with the current leading instead of lagging, but with increased higher-frequency current components. It tends to be more efficient in operation with little ohmic loss, but does not have the desirable igniter starting characteristic of an inductive ballast with contactors. A combination of leading and lagging ballasts may be used for lamp pairs, thereby correcting power factor, but not necessarily correcting waveform.

Series resistive ballasting has good power factor and waveform, but poor efficiency, and is not considered a viable alternative.

A power factor corrected ballast using a capacitor across the input line to tune out the series inductive reactance at 60 hertz has been tested. While this configuration corrected the power factor, it raised the third harmonic current from about 8% to 12%.

Another type of power factor correction that is commonly used in rapid-start magnetic ballasts involves the use of a series capacitor to resonate with the inductor at 60 hertz. The current drawn in such a resonant circuit is typically a distorted sine wave, and would not be likely to meet stringent harmonic requirements.

It is an object of the present invention to provide a new and improved magnetic ballast of the series inductive type which will have a high power factor and a low harmonic content, as well as improved efficiency. One specific circuit of the present invention exhibits a power factor greater than 0.95 with a harmonic content of less than 5%, and power savings in comparison with the conventional single series inductance in the order of 10%.

Other objects, advantages, features and results will more fully appear in the course of the following description.

SUMMARY OF THE INVENTION

A ballast circuit for a fluorescent lamp for connection between ac line terminals and lamp load terminals, the ballast circuit including first, second and third inductances connected at a junction, with a capacitance connected between the first inductance and one line and load terminal, the second inductance connected to the other load terminal, and the third inductance connected to the other line terminal. In the preferred embodiment, the first and second inductances comprise a tapped autotransformer with the third inductance connected at the tap. In another embodiment, all three inductances may be wound on a single core. In situations where space is a problem, an additional separate inductance may be provided in series with the first inductance. In another alternative embodiment, separate inductances may be utilized in place of the autotransformer configuration.

DESCRIPTION OF THE PREFERRED EMBODIMENTS

Figure 1:
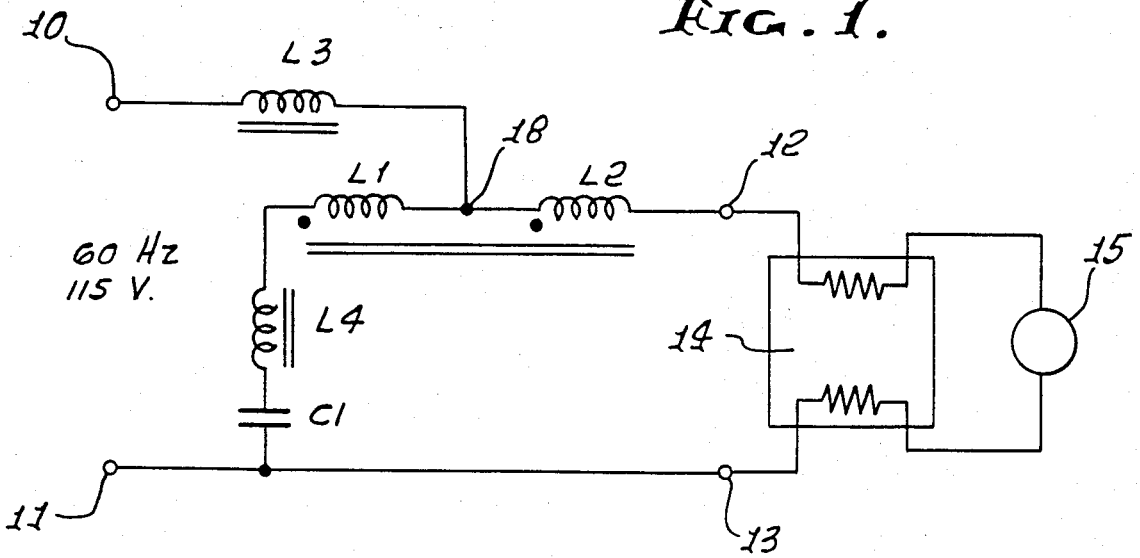
FIG. 1 is an electrical schematic of a magnetic ballast circuit for a fluorescent lamp and incorporating the presently preferred embodiment of the invention.

In the circuit of FIG. 1, a magnetic ballast is connected between line terminals 10, 11 and load terminals 12, 13. A fluorescent lamp 14 with starter 15 is connected across the load terminals 12, 13. A typical supply voltage, such as 115 volts at 60 hertz is connected to the line terminals 10, 11.

Inductances L1, L2 and L3 are connected at a junction 18. In the embodiment illustrated, the inductances L1 and L2 are formed as a tapped winding on an autotransformer, and the inductance L3 is connected between load terminal 10 and the autotransformer tap or junction 18. A capacitance C1 is connected between the inductance L1 and the other line terminal 11. When needed, an additional inductance L4 is connected in series with the inductance L1. The inductance L2 is connected to the load terminal 12, and the line terminal 11 and load terminal 13 are connected together.

In the embodiment illustrated in FIG. 1, the autotransformer configuration is preferred because it permits manufacture of the circuit with lower inductance magnitudes for L1 and L2 where the currents are high, and therefore fewer turns and lower ohmic losses. When winding space on the particular core utilized permits, the inductance L4 may be combined with the inductance L1.

The circuit of FIG. 1 operates as a low pass filter with a rejected frequency region. At the same time, it has the desired swinging choke characteristics needed for preheat starting of the lamp, which an ordinary low pass filter does not have.

The magnitude of the capacitance C1 and of the inductance L1 (or L1 plus L4) is selected so that the series circuit will resonate at or about the third harmonic of the line frequency. The capacitance C1 may be positioned as shown in FIG. 1 or may be positioned between the inductances L1, L4. The magnitude of the inductance L2 is selected so as to limit the lamp current to a predetermined value and is selected depending upon the particular lamp, its current rating, and the desired output. The inductance L3 serves to prevent oscillation in the circuit and filter harmonics of the line frequency from the line. While the greater the inductance, the better the filtering action, it is preferred to choose the magnitude of inductance of L3 to be as low as possible in order to hold down the iron and wire requirements. The magnitudes of the various components for one specific circuit is set out in Table 1, where M is the mutual inductance of the autotransformer. For this particular circuit operating at 60 hertz, the power factor was greater than 0.95, the harmonic content was less than 5%, and the power saving over a corresponding circuit with a conventional single series inductance was in the order of 10% using a larger wire diameter.

Figure 2:
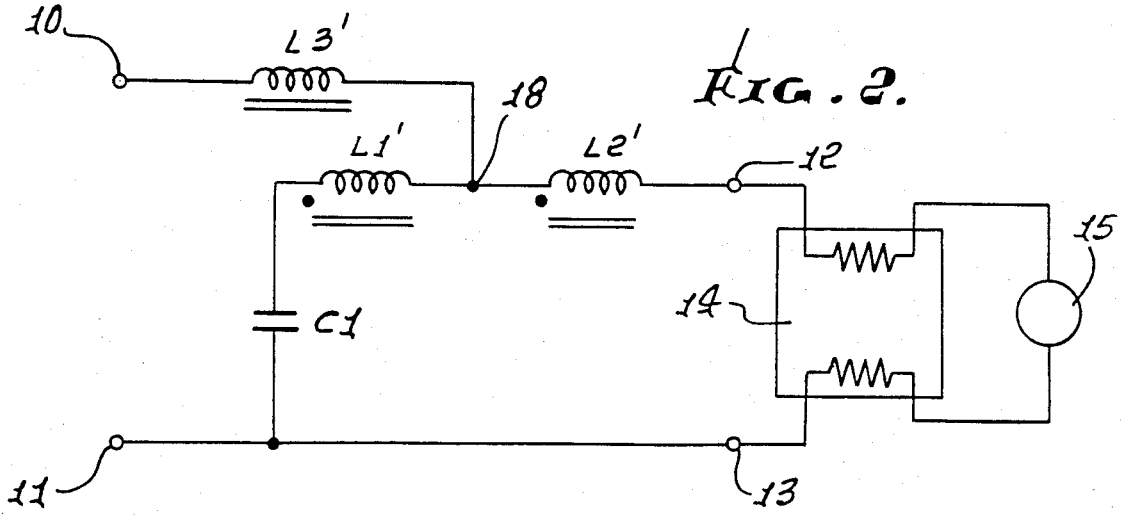
FIG. 2 is an electrical schematic similar to that of FIG. 1 showing an alternative embodimemt of the invention.

An alternative configuration for the magnetic ballast is shown in FIG. 2, where elements corresponding to those of FIG. 1 are identified by the same reference numerals. In the circuit of FIG. 2, separate inductances L1′ and L2′ are used in place of the autotransformer. The capacitance C1 may be positioned as shown or may be positioned between the inductance L1′ and junction 18. The operation of the circuit is the same as for the circuit of FIG. 1, and values for components are set out in Table 2. While this configuration is easier to analyze, the magnitudes of inductance required are greater and hence the resultant circuit is larger and more expensive than that of FIG. 1.

Figure 3:
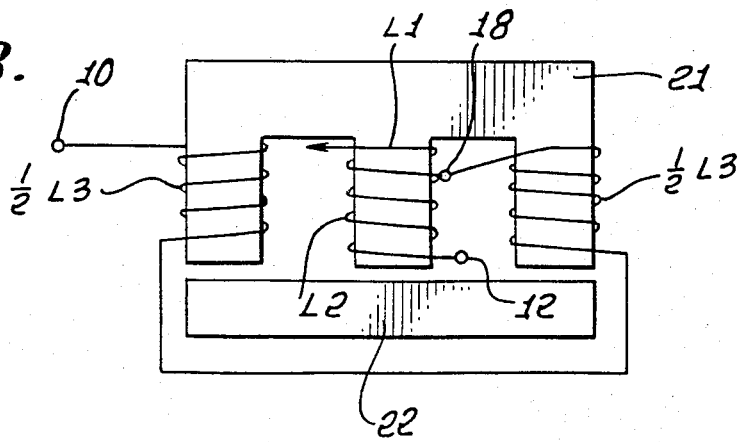
FIG. 3 illustrates a core and coil configuration suitable for use in the circuit of the invention.

FIG. 3 illustrates the winding of all three inductances on a single core using a conventional core arrangement with an E stack 21 and an I stack 22. The inductances L1 and L2 are wound on the center leg, and one half of inductance L3 is wound on each of the outer legs. With this arrangement, the magnitude of the inductance L3 is independent of the center leg. With this configuration, the major air gap would be at the center leg, and depending upon the specific design, only a small gap or no gap at all would be needed at the outer legs.

TABLE 1

| (FIG. 1) 60 hertz 115 volts | | | |
|---|---|---|---|
| L1 | 23.5 mh | M | 83 mh |
| L2 | 294 mh | Cl | 6 microfareds |
| L3 | 112 mh | lamp | 20 watt |
| L4 | 59 mh | | |

TABLE 2

| (FIG. 2) 60 hertz 115 volts | | | |
|---|---|---|---|
| L1′ | 166 mh | Cl | 6 microfareds |
| L2′ | 377 mh | lamp | F20T12CW |
| L3′ | 29 mh | | |

I claim:

1. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with the magnitudes of said first inductance and said capacitance selected to be a series resonant circuit at a frequency of about three times the frequency of the line voltage connected at said line terminals.

2. A ballast circuit as defined in claim 1 wherein said first and second inductances comprise an autotransformer, with said third inductance connected at a tap on said auto transformer.

3. A ballast circuit as defined in claim 1 wherein said first, second and third inductances are separate windings on three separate cores.

4. A ballast circuit as defined in claim 1 wherein the inductance of said second inductance is selected to limit the current to a lamp connected at said load terminals to a predetermined amount.

5. A ballast circuit as defined in claim 8 wherein the inductance of said third inductance is selected to filter harmonics of the line frequency between said load terminals and said line terminals.

6. A ballast circuit for a fluorescent lamp, comprising in combination:

means defining first and second line terminals;

means defining first and second load terminals, with said second line terminal connected to said second load terminal;

first, second and third inductances connected at a junction;

a capacitance connected in series with said first inductance between said junction and said second line terminal, with said second inductance connected to said first load terminal and said third inductance connected to said first line terminal;

with said first and second inductances comprising an autotransformer, with said third inductance connected at a tap on said autotransformer; and a fourth inductance separate from said autotransformer and connected in series with said first inductance and said capacitance.

7. A ballast circuit as defined in claim 6 wherein the magnitudes of said first and fourth inductances and said capacitance are selected to be a series resonant circuit at a frequency of about three times the frequency of the line voltage connected at said line terminals.

8. A ballast circuit for a fluorescent lamp, comprising in combination:

means defining first and second line terminals;

means defining first and second load terminals, with said second line terminal connected to said second load terminal;

first, second and third inductances connected at a junction; and a capacitance connected in series with said first inductance between said junction and said second line terminal, with said second inductance connected to said first load terminal and said third inductance connected to said first line terminal;

with said first and second inductances comprising an autotransformer, with said third inductance connected at a tap on said autotransformer; and with said first, second and third inductances wound on a single core, with said first and second inductances having a tapped winding on one leg of said core and said third inductance having a winding on at least one other leg of said core.

9. A ballast circuit as defined in claim 8 wherein said core has three parallel legs, with said tapped winding of said first and second inductances on the center leg thereof and with said winding of said third inductance formed in two sections on the outer legs thereof.

* * * * *